United States Patent [19]

Comastri et al.

[11] 4,072,954

[45] Feb. 7, 1978

[54] MULTIBAND ANTENNA FOR WINDOW PANES

[75] Inventors: Mauro Comastri, Monza; Giorgio Ciarniello, Vasto (Chieti), both of Italy

[73] Assignee: Societa Italiana Vetro Siv S.p.A., Vasto (Chieti), Italy

[21] Appl. No.: 708,760

[22] Filed: July 26, 1976

[30] Foreign Application Priority Data

July 24, 1975 Italy ..... 50650/75

[51] Int. Cl.[2] ..... H01Q 1/32

[52] U.S. Cl. ..... 343/713

[58] Field of Search ..... 343/711, 712, 713

[56] References Cited

U.S. PATENT DOCUMENTS

| | | | |
|---|---|---|---|
| 3,771,159 | 11/1973 | Kawacuchi | 343/713 |
| 3,845,489 | 10/1974 | Sauer et al. | 343/713 |
| 3,971,030 | 7/1976 | Sauer | 343/713 |
| 4,003,056 | 1/1977 | Davis | 343/713 |

*Primary Examiner*—Eli Lieberman

*Attorney, Agent, or Firm*—Browdy and Neimark

[57] ABSTRACT

A multi-band windshield or window antenna has a fishpole-type conductor for metric wave band signal reception, the fishpole-type conductor having a free upper end, which may be split or folded back upon itself. At least one second conductor is provided for the reception of medium wave band signals. Each second conductor is connected to a common terminal with the fishpole-type conductor, extends along adjacent at least a portion of a first horizontal rim of the windshield, is bent back upon itself, extends vertically parallel to said fishpole-type conductor, horizontally adjacent to a second horizontal rim of the windshield and then vertically adjacent to a vertical rim of the windshield.

11 Claims, 4 Drawing Figures

MULTIBAND ANTENNA FOR WINDOW PANES

BACKGROUND OF THE INVENTION

The present invention refers to a radio-receiving multiband antenna supported on window panes, particularly for a windshield of motor vehicles. The term "window pane" is intended to mean in this connection a pane of glass or of plastic material and the antenna may consist of electric conductors deposited by the silk screen process on the pane, preferably on that face of the pane which, when fitted into the car, is the internal one; or else, if in lieu of tempered glass, two bonded together glass panes are used, applied to that face of the pane, which is in contact with the other face. Obviously, in lieu of conductors made by the silk screen process, also a conducting metal wire may be used.

Obviously, such antenna may be applied to any window of a motor vehicle, although the windshield is the most suitable place.

The antenna according to the present invention has been designed to receive radio-frequency signals in their various bands of transmissions, such as long waves, medium waves, short waves, metric or frequency modulation waves (FM) and VHF, decimetric waves and UHF and all the waves for sound and/or television information, included the frequencies reserved for radio amateurs.

The antenna incorporated in the pane, particularly in the windshield, is preferred to the conventional, freely supported motorcar antennas, because they are subjected to various drawbacks, such as:

a) considerable vibrations during driving which render the signal fluctuating, particularly when receiving distant stations and the receiver operates in threshold conditions;

b) marked instability in their characteristics, such as increase of their resistance and consequent increase in their losses, changes in the capacity of the antenna, due to its aging, to the possibility of water penetration in the cylindric bottom element, which causes corrosion and oxidation of the tubular elements in a polluting or brackish atmosphere;

c) in the case of fishpole antennas, the fact that they strongly project beyond the motorcar contours, which leads often to their breaking, for instance when entering a garage, an underpass, etc., or damaging persons and goods if they are badly installed;

d) furthermore the fishpole antenna is also subject to be willfully broken by vandals.

For all these reasons windshield antennas have been developed.

It is well known that the major part of radio-receiving sets for motor vehicles is provided with a single aerial socket, differently from the domestic receivers which have an input for the medium waves and one for the metric waves (FM), therefore a problem which must be faced in the aerials embedded in motorcar windshields is that of obtaining good reception of the medium waves as well as of the metric waves in a single antenna socket of the radio-receiving set.

In the prior art various shapes of antennas incorporated or embedded in windshields have been suggested, in an attempt to ensure a good reception in all wave bands. For this purpose antennas have been devised having one central vertical fishpole-type straight or T-shaped element, which afford a good reception particularly in the field of metric waves, and have also been devised antenna elements of greater length which run along the rim of the glass pane, forming so-called "rim" conductors, which afford a good reception in the field of medium waves. However, the problem in these types of antennas with the distinct receiving elements in the various frequency bands is that the signals received by the individual elements conjoin correspondingly to the single input of the radio receiver, and thus it is difficult to obtain a good reception throughout all wave bands, since an antenna built for instance to give a good reception in medium waves is generally not fitted with the characteristics which may confer to it a good yield also in the reception of metric waves and vice-versa. In the prior art there have been suggested types of antennas which were supported on the windshield of a motor vehicle, wherein that part of the antenna which was suitable for a certain frequency band, form an undesirable load when the antenna must operate for a different frequency band and furthermore, in particular in the reception of metric waves, these types of known antennas have a very variable efficiency in the various directions of reception.

SUMMARY OF THE INVENTION

According to the present invention, it has been found that some antenna structures are capable of receiving with an optimum efficiency both the signals in the range of the medium waves (550–1600 KHz) and those in the frequency modulation range (87.5 – 108 MHz). In fact, the electric characteristics of the windshield antenna according to the present invention excellently satisfy those which are required by the greater part of the radio-receiving sets presently marketed, which require a very high antenna capacity of 70–100 pF (a capacity value which, added to the capacity of the coaxial cable and of the connector permits, by means of the trimmer provided in the receiver, to obtain the best possible tuning between the antennas and the receiver at a capacity around 150 pF) with a high resistance to losses (some hundreds of kohm) in the medium waves band and an antenna impedance of approximately 150 ohm which is prevalently resistive and with a phase contained within $\pm$ 30° within the band of metric waves.

In order to obtain a good reception, the ideal would be to have the length of the antenna conductors equal to a well defined fraction of the wave length $\lambda/2$ – $\lambda/4$ according to whether the antenna is of the symmetric or assymmetric type.

Since it is impossible, at least for the medium waves, to have wires of the length equal to $\lambda/4$ (187/4 – 570/4 meters) owing to the natural limitations inherent to the windows of a motor vehicle, an antenna has been designed which, although in its reduced development, insures an excellent efficiency of reception both in the medium wave band and in the frequency modulation band.

This has been rendered possible, according to the invention, by adapting the antenna in such a manner that its section prevalently contributes to the reception of the signal in a given frequency band and another section contributes prevalently to the reception of the signal of another frequency band, but each section contributes also to the section of the signal having a frequency included in the band which is that prevalently received by the other section. In such a manner, in lieu of having two antenna sections, each of which becomes active in the reception of a certain frequency band, while the other section is devoid of any utility or even a source of parasite load as it happens in the prior art – in the antenna according to the invention both sections give an active contribution to the reception of the signal, and therefore this antenna is actually a true and real multi-band antenna which functions in an optimum manner for the most diverse frequency bands and in addition to it with respect to the known technique, it presents a convenient and regular efficiency of reception in all possible directions.

This result has been obtained by an antenna having a geometry such as to satisfy extemely exacting requirements with regard to the impedance of the antenna circuit, by conferring a given configuration to the conductors of the antenna and positioning them with respect to the rims of the windshield in such a manner as to obtain, in the reception of the metric waves, a practically real magnitude of said impedance, approaching the optimum of 150 ohm.

In order to attain this result the prevalently active part of the antenna consists of a fishpole-type conductor preferably located correspondingly to the vertical center line of the pane.

That part, which is prevalently active in the medium wave range consists of conductors which originate from the same antenna terminal from which extends the fishpole-type conductor, and they form on each part of the pane, to either side of the fishpole-type conductor, two peripheral configurations presenting, in that section of the conductor which is adjacent to the lower pane rim, a looped or doubled back section having a length equal to an uneven multiple of $\lambda/4$, wherein a $\lambda$ is the wave length corresponding to the central frequency of the metric wave band; these elements adapt this antenna section to the fishpole section and keep the impedance value characteristic of the whole in the neighborhood of 150 ohm in the above quoted frequency band.

The arrangement according to the invention has the advantage of permitting the compensation of the reactive impedance component of the fishpole in a wide range of desired frequencies. The looped sections running horizontally along the lower windshield rim have also the function of raising the minima of the directivity curves, thereby actively contributing to the signal pickup, which is particularly valuable for those directions in which the pickup of the fishpole is minimal.

The overall impedance of the antenna, while it has been adapted in such a manner, will vary in the frequency range from 87.5 – 100 MHz between 100 and 200 ohm and transfer in this manner the maximum input to the car radio which requires an optimum impedance of 150 ohm.

The term "adapted" is intended to mean that, during reception, the maximum power transfer from the antenna to the receiver input is obtained, the contribution of the receiving element is prevalent, whereas the remaining portion of the antenna gives a contribution of the order 10 – 30% which adds to the other element; in FM the prevalent receiving element is the central fishpole antenna, while in the medium waves the receiving element is the remaining portion of the antenna which runs along the rim of the glass pane, spaced a few centimeters therefrom; the optimum distance from the rim depends on the dimension of the glass pane.

It has been found that the length of the fishpole portion of the antenna essentially depends from the size of the glass pane, but having regard to the condition that its length must be a well defined fraction of the wave length, for instance $\lambda/4$.

Such length of the fishpole may also vary according to whether it consists of a silver deposit applied by the well-known silk screen process to the glass, or whether it is a very thin wire, such as a wire of 1–2 tenths of a millimeter placed on a plastic sheet and sandwiched between two glass panes in order to form a safety glass. In fact the speed of propagation of electromagnetic waves is different according to whether reception occurs on the external surface of the glass or in the interface between two glasses.

The correct length of the conductor is computed, for each single case, on the basis of these data, in order to obtain the resonance to the desired frequencies, so as to have, in the reception of the metric waves, a prevalently resistive antenna impedance around 150 ohm and therefore a maximum transfer of the signal fed into the receiver.

For that antenna section which is particularly intended for medium waves, a shape and a structure have been found which are capable of ensuring the maximum possible capacity (approximately 100 picofarad) and a high resistance loss of value in order to minimize the partition of the signal picked up by the antenna, that is to say capable of transferring to the receiver terminal the maximum possible signal.

In fact, it has been found that the reception capacity is better when the conductor is spaced farther away from the windshield rim and therefore it is convenient in the selection of the spacing of the peripheral conductors from said rim, to obtain a correct compromise between a good antenna capacity and a high pick-up efficiency.

In the picking-up of medium waves by means of antenna configurations according to the invention it has been found that a good antenna capacity is obtained when the peripheral conductor is located at an optimum distance of approximately 7 cm. from the windshield rim; to further increase the antenna capacity, the ends of the peripheral conductors are looped back and extended to form an extension running parallel to said peripheral conductors. When the size of the windshield permits it, without interfering with the area of visibility, it is advantageous to increase the spacing of the peripheral conductors from the windshield rim to approximately 9 – 10 cm.

BRIEF DESCRIPTION OF THE DRAWINGS

The invention will be better understood from the following description of some of its embodiments, made with reference to the attached drawings, wherein.

DETAILED DESCRIPTION OF THE PREFERRED EMBODIMENTS

Figure 1:
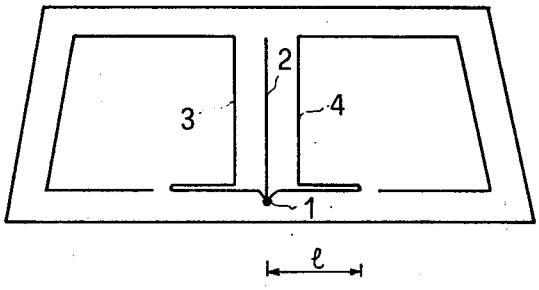
FIG. 1 shows a first embodiment.

With reference to FIG. 1, the terminal for the collection of the antenna with the car-radio receiver is positioned, correspondingly to the vertical center line of the windshield, a few centimeters above the lower windshield rim. A fishpole-type conductor 2 extends from this terminal upward to end a few centimeters below the upper windshield rim and serves prevalently for the metric waves.

From this terminal 1, there branch into opposite directions two antenna conductors 3 and 4 which follow the lower windshield rim for a given stretch, double back into a loop to parallel the course of the aforesaid stretch, but internally of it. At a short distance from the fishpole conductor 2, the conductors 3 and 4 bend vertically upward until reaching the approximate level of the upper end of conductor 2, and turn thereafter to the left and to the right respectively of the fishpole conductor into a parth paralleling the windshield frame at a distance and terminate short of said loop. Conductors 3 and 4 form the active elements of the antenna for the reception of medium waves and the looped stretch forms the line of adaptation for the fishpole conductor 2 which is prevalently active for the metric wave reception.

Figure 2:
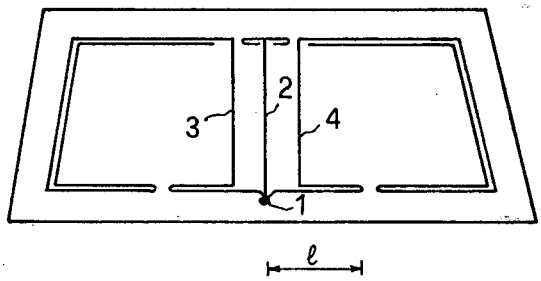
FIG. 2 shows an antenna similar to that of FIG. 1, but with the conductors which are adjacent to the rim doubled back in the above mentioned manner.

In FIG. 2 the conductors 3 and 4 are bent back at their ends and are prolonged to form an extension paralleling the peripheral sides of conductors 3 and 4 respectively. This is useful when it is desired to attain the total capacity required and the windshield has a size insufficient for this purpose.

For instance it has been found that an optimum adaptation is obtained when the length (1) of the doubled section of the conductors 3 and 4 ranges between 28 and 35 cm.

It has also been found that the presence of the vertical stretches of conductors 3 and 4 which run parallel to conductor 2 causes an improvement in the pick-up of medium waves. In this respect the distance of said vertical length of conductors 3 and 4 from conductor 2 is approximatey 7 cm. and may vary on the condition that the visibility requirements of the windshield are not impaired.

In the embodiment of FIG. 2 it is preferable that the distance between the conductors 3 and 4 respectively and their extensions remains between 1.2 and 0.2 cm.

EXAMPLE 1

On a windshield having the size 60 × 130 cm. an antenna of the type illustrated in FIG. 1 has been applied, wherein the terminal 1 lies approximately 5 cm. from the lower windshield rim and the length of conductor 2 is 51 cm. The length, taken in the horizontal sense, of the looped back stretch is 32 cm. and the vertical legs of conductors 3 and 4 are spaced 7 cm. from conductor 2. Conductors 3 and 4 follow the windshield rim at a distance of 7 cm. therefrom and terminate 1 cm. from the loop.

This antenna had a capacity of approximately 80 picofarad, which was optimal for the reception of medium waves and the fishpole conductor 2 was brought into resonance at 95 MHz, which represents the center of the metric wave band; therefore an excellent pick-up was obtained even in the FM band.

An antenna of the type shown in FIG. 2, applied to a windshield of the size of 60 × 130 cm. has been tested with regard to the voltage measured at the terminal 1, said voltage being compared with that obtained by a conventional T-shaped antenna applied to the same windshield.

The results are indicated in the following table, wherein the voltage values obtained with the antenna according to FIG. 2 are compared with those of a conventional T-antenna taken as 1, in the reception of medium and in metric waves.

Figure 4:
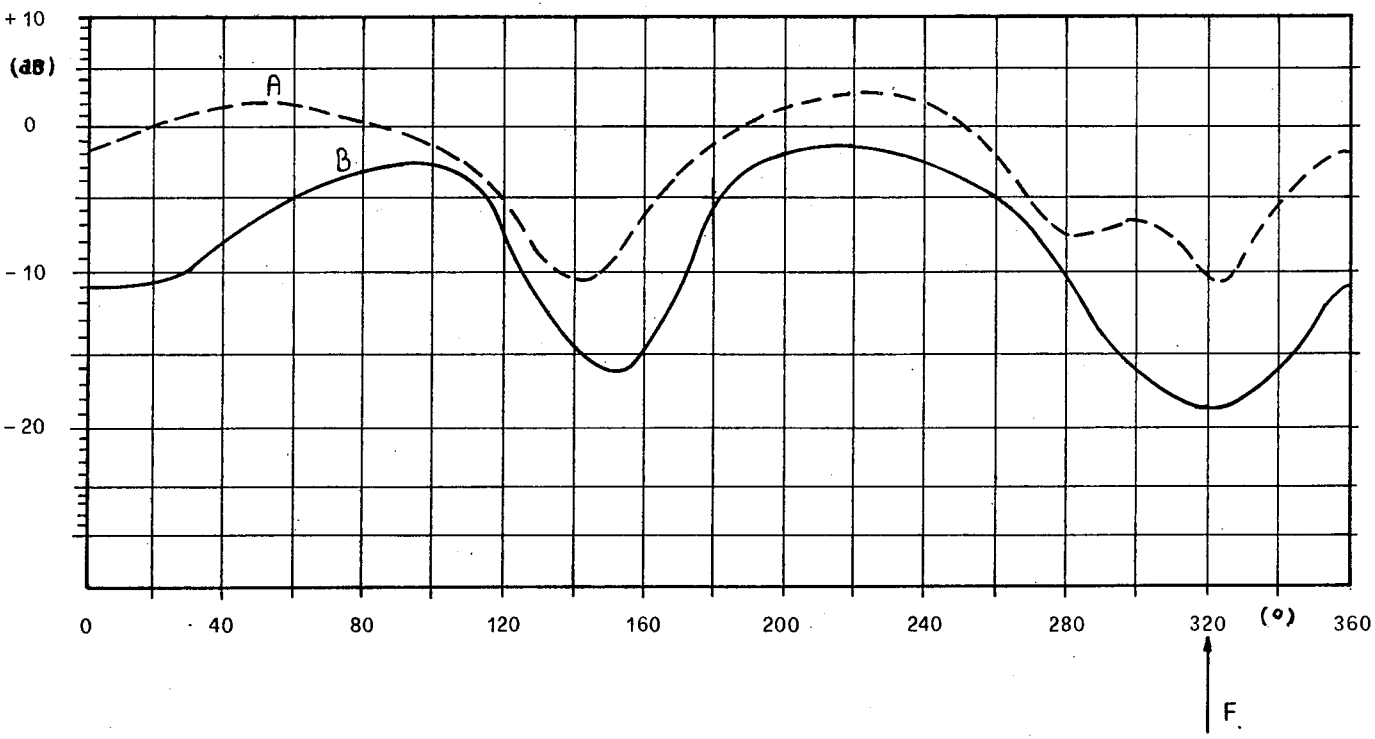
FIG. 4 is a directivity diagram, showing the performance of an antenna according to the present invention in comparison with that of a T-type antenna of the known art.

The decisive improvement in the directivity charactristics of the antennas according to the invention clearly result from the diagram of FIG. 4, where the ordinates indicate the decibels and the abcissa the orientation in degrees. The pick-up efficiency of an antenna of the type illustrated in FIG. 2 is indicated by curve A, while those of a conventional T-antenna is given by curve B. The arrow F indicates the direction of the transmitter which broadcasts at a FM frequency band of 92.1 MHz.

Curve B has a minimum of sensitivity correspondingly to approximately 140° and 320° respectively while curve A has a substantially more constant response, especially around 300°, that is to say when the transmitter lies in direction towards which the vehicle is turned. The minimum around 140° corresponds to a transmitting station located behind the windshield.

Figure 3:
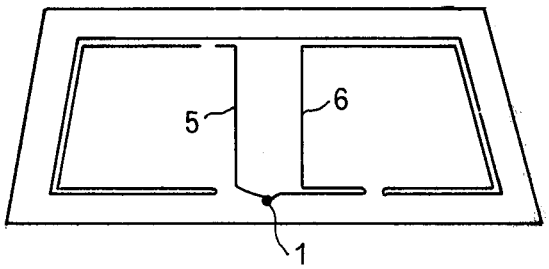
FIG. 3 is another emobodiment.

Another embodiment of the antenna is shown in FIG. 3, wherein the whole antenna, instead of consisting of three conductors issuing from terminal 1 is formed of only two conductors, i.e. a conductor 5 which forms the fishpole section and a conductor 6 which forms the section bordering the windshield rim. As shown in the figure, conductor 6 forms a first loop, rises thereafter upward, bends, correspondingly to the upper end of conductor 5, sharply away from it, forms a first leg bordering the windshield contour, forms a second loop short of the first one to reverse its path along a course which borders the windshield rim, forms a second leg on the opposite side of conductor 5, which leg follows the windshield contour until it reaches the vicinity of terminal 1, where it forms a third loop and reverses its path to form a third antenna leg running parallel to the second one. Also this type of antenna has the advantageous features of the embodiments shown in FIG. 1 and FIG. 2.

It is obvious that the above described embodiments have a purely illustrative and in a no way limitative purpose and that any changes and variations in their geometry are encompassed in the scope of the present invention.

What is claimed is:

1. In a multi-band windshield or window antenna having a fishpole-type conductor for metric wave band signal reception and having a free upper end portion extendng to a given level, and at least one conductor running along in close vicinity to a periphery of the windshield or windowpane for the reception of medium wave band signals, all conductors conjoining at a common terminal located adjacently to a first rim of the windshield or window, the improvement wherein each conductor for medium wave signals extends in a generally horizontal direction from said common terminal for a distance adjacent said first rim, then doubles back on itself to form a first loop, at the end of which it bends upward into a generally first vertical leg running parallel to and in close vicinity to said fishpole-type conductor, until substantially reaching said given level of said free end portion of said fishpole-type conductor, to bend thereat away from said fishpole-type conductor and run along adjacent to at least a portion of a second rim of said windshield or window, and then bends downwardly and extends toward said first rim, running along adjacent to a third rim of said windshield or window to define a second vertical leg, whereby the at least one conductor for the reception medium wave band signals also participates in picking up of the metric wave band signals and the fishpole-type conductor also participates in picking up of the medium wave band signals.

2. An antenna according to claim 1, wherein said loop has a length corresponding to one fourth of the central wave length of the metric wave band.

3. Antenna according to claim 1, wherein the conductors for the medium wave band are two, one at each side of the fishpole conductor, each conductor ending short of the loop formed by it.

4. Antenna according to claim 3, wherein each conductor is prolonged by doubling it back at its end into a second loop to form an extension running parallel to at least one part of said conductor (FIG. 2).

5. Antenna according to claim 3, wherein said extension runs parallel to said conductor up to the location where said conductor bends away from the fishpole-type conductor (FIG. 2).

6. Antenna according to claim 1, wherein a single conductor is provided for the medium wave band, said conductor, after forming said first loop and bending away from said fishpole-type conductor, borders the windshield rim at one side of said fishpole conductor, doubles thereafter back into a second loop adjacently to said first loop to form an extension paralleling the path of said conductor, passing beyond the location where said conductor bends away from said fishpole conductor to run parallel to the windshield rim lying on the opposite side of said fishpole conductor, doubles back to form a third loop at a short distance from the antenna terminal and run parallel to said extension to end adjacently to said free end of said fishpole antenna.

7. Antenna according to claim 1, wherein the distance between said fishpole conductor and the upward leg of each medium wave band conductor is comprised between 6 – 70 mm.

8. Antenna accordng to claim 4, wherein the distance between said first and said second loop ranges from 0.2 – 1.2 cm.

9. Antenna according to claim 6, wherein the distance between said first and said second loop ranges from 0.2 – 1.2 cm.

10. Antenna according to claim 4, wherein each conductor is spaced 1.2 – 0.2 cm. from the extension running parallel to it.

11. Antenna according to claim 6, wherein each conductor is spaced 1.2 – 0.2 cm. from the extension running parallel to it.

* * * * *